US007060976B2

(12) United States Patent
Sheehan et al.

(10) Patent No.: US 7,060,976 B2
(45) Date of Patent: Jun. 13, 2006

(54) ION ENRICHMENT APERTURE ARRAYS

(75) Inventors: Edward William Sheehan, Pittsbugh, PA (US); Ross Clark Willoughby, Pittsbugh, PA (US)

(73) Assignee: Chem-Space Associates, Pittsburgh, PA (US)

( * ) Notice: Subject to any disclaimer, the term of this patent is extended or adjusted under 35 U.S.C. 154(b) by 0 days.

(21) Appl. No.: 11/173,377

(22) Filed: Jul. 2, 2005

(65) Prior Publication Data

US 2005/0269503 A1 Dec. 8, 2005

Related U.S. Application Data

(63) Continuation of application No. 10/863,130, filed on Jun. 7, 2004, now Pat. No. 6,914,243.

(60) Provisional application No. 60/476,582, filed on Jun. 7, 2003.

(51) Int. Cl.
*B01O 59/44* (2006.01)
*H01J 49/00* (2006.01)

(52) U.S. Cl. ..... 250/288; 250/281; 250/286; 250/294; 250/283

(58) Field of Classification Search ..... 250/288, 250/294, 283, 281
See application file for complete search history.

(56) References Cited

U.S. PATENT DOCUMENTS

| | | | | |
|---|---|---|---|---|
| 6,744,041 | B1 * | 6/2004 | Sheehan et al. | 250/283 |
| 6,818,889 | B1 * | 11/2004 | Sheehan et al. | 250/288 |
| 6,897,437 | B1 | 5/2005 | Fuhrer et al. | |
| 2002/0011560 | A1 * | 1/2002 | Sheehan et al. | 250/283 |

* cited by examiner

*Primary Examiner*—Nikita Wells
*Assistant Examiner*—Johnnie L Smith, II

(57) ABSTRACT

Improvements have been made for selective collecting, focusing, and directing of ions and/or charged particles generated at atmospheric or near atmospheric pressure sources, such as but not limited to, electrospray; atmospheric pressure discharge ionization, chemical ionization, photo-ionization, and matrix assisted laser desorption ionization; and inductively coupled plasma ionization. A multiple-aperture laminated structure is place at the interface of two pressure regions. Electric fields geometries and strengths across the laminated structure and diameters of the apertures; all of which act to optimize the transfer of the ions from the higher pressure region into the lower pressure region while reducing the gas-load on the lower pressure region. Embodiments of this invention are methods and devices for improving sensitivity of mass spectrometry when coupled to atmospheric, near atmospheric, or higher pressure ionization sources by reducing the gas-load on the vacuum system.

21 Claims, 12 Drawing Sheets

ION ENRICHMENT APERTURE ARRAYS

CROSS-REFERENCE TO RELATED APPLICATIONS

This is a continuation application Ser. No. 10/863,130, filed 2004 Jun. 7; U.S. Patent Application Publication 2004/0245458, issued 2004 Dec. 9; now U.S. Pat. No. 6,914,243, issued 2005 Jul. 5. This application is entitled to the benefit of Provisional Patent Application Ser. No. 60/476,582, filed 2003, Jun. 7. This application is related to patent application Ser. No. 09/877,167, filed 2001 Jun. 8, now U.S. Pat. No. 6,744,041, issued 2004 Jun. 1; patent application Ser. No. 10/155,151, filed 2002 May 25, now U.S. Pat. No. 6,784,424, issued 2004 Aug. 31; patent application Ser. No. 10/449,147, filed 2003 May 31, now U.S. Pat. No. 6,818,889, issued 2004 Nov. 16; patent application Ser. No. 10/449,344, filed 2003 May 30, now U.S. Pat. No. 6,888,132, issued 2005 May 3; patent application Ser. No. 10/661,842, filed 2003 Sep. 12, now U.S. Pat. No. 6,949,740, issued 2005 Sep. 27; patent application Ser. No. 10/688,021, filed 2003 Oct. 17; now U.S. Pat. No. 6,943,347, issued 2005 Sep. 13; patent application Ser. No. 10/785,441, filed 2004 Feb. 23, now U.S. Pat. No. 6,878,930, issued 2005 Apr. 12; patent application Ser. No. 10/862,304, filed 2004 Jun. 7, now Patent Application Publication 2005/0056776, issued 2005 Mar. 17; patent application Ser. No. 10/989,821, filed 2004 Nov. 15; patent application Ser. No. 11/120,363, filed 2005 May 2; patent application Ser. No. 11/135,769, filed 2005 May 24; and International Patent Application Ser. No. PCT/US2004/018276, filed 2004 Jun. 7, now WO Patent Publication 2004/110583, issued 2004 Dec. 23.

SEQUENCE LISTING OR PROGRAM

Not Applicable

FEDERALLY FUNDED RESEARCH

The invention described herein was made with the United States Government support under Grant Number: 1 R43 RR143396-1 from the Department of Health and Human

BACKGROUND OF THE INVENTION

1. Field of Invention

The present invention is intended to transmit ions from higher to lower pressure regions such as atmospheric pressure interfacing of ionization sources to chambers containing mass spectrometers or ion mobility spectrometers.

2. Description of Prior Art

Dispersive sources of ions at or near atmospheric pressure; such as, atmospheric pressure discharge ionization, chemical ionization, photoionization, or matrix assisted laser desorption ionization, glow discharge, and electrospray ionization generally have low sampling efficiency through conductance or transmission apertures, where less than 1% [often less than 1 ion in 10,000] of the ion current emanating from the ion source make it into the lower pressure regions of the present commercial interfaces for mass spectrometry.

U.S. Pat. No. 4,542,293 to Fenn, et al. (1985) demonstrated the utility of utilizing a dielectric capillary, a glass tube, to transport gas-phase ions from atmospheric pressure to low pressure where the viscous forces within a capillary push the ions against a potential gradient. This technology has the significant benefit of allowing grounded needles with electrospray sources. Unfortunately, this mainstream commercial technology transmits only a fraction of a percent of typical atmospheric pressure generated ions into the vacuum. The majority of ions being lost at the inlet due to dispersive fields dominating the motions of ions (see FIG. 8). The requirement of capacitive charging of the tube for stable transmission, as well as, transmission being highly dependent on surface charging creates limitations on efficiencies with this technology. Contamination from condensation, ion deposition, and particulate materials can change the surface properties and the transmission. Because of the large surface area contained on the inner wall surface, a large amount of energy is stored and can discharge and damage the electrode surfaces. Care must also be taken to keep the outer surfaces clean and unobstructed, presumably in order not to deplete the image current that flows on the outer surface of the glass tube.

U.S. Pat. No. 4,977,320 to Chowdhury, et al. (1990) demonstrated the use of heated metal capillaries to both generate and transmit ions into a vacuum chamber. The efficiencies of this device are low as well. This technology samples both ions and charged droplets into the capillary where, with the addition of heat, ion desorption is facilitated. Undergoing coulomb explosions inside the restricted volume of the tube will tend to cause gas-phase ions to be loss to the walls of the tube due to dispersion. In addition, this technique encounters the same limitation from dispersion losses at the inlet as the dielectric capillaries.

Lin and Sunner (1994) (J. American Society of Mass Spectrometry, Vol. 5, Number 10, pp. 873–885, October 1994) studied a variety of effects on transmission through tubes of glass, metal, and Teflon. A wide variety of parameters were studied including capillary length, gas throughput, capillary diameter, and ion residence time. Effects from space charge, diffusion, gas flow, turbulence, spacing, and temperature where evaluated. These studies failed to identify the field dispersion at the inlet as the major loss mechanism for ions in capillaries. Some important insights where reported with respect to general transmission characteristics of capillary inlets.

U.S. Pat. No. 5,736,740 to Franzen (1998) proposed the use of weakly conducting inner surfaces to prevent charge accumulation as a means to facilitate the focusing of ions toward the axis of the capillary. Although it is difficult to distinguish this art from Fenn in that the glass tubes utilized in commercial applications under Fenn also utilize weakly conducting dielectric surfaces, Franzen does argue effectively for the need to control the inner surface properties and the internal electric fields. This device will suffer from the same limitations as Fenn.

U.S. Pat. No. 5,747,799 to Franzen (1998) also proposed the need to focus ions at the inlet of capillaries and apertures in order enhance collection efficiencies. In this device the ions are said to be entrained into the flow by viscous friction. This invention also fails to account for the dominance of the electric field on the motion of ions in the entrance region. At typical flow velocities at the entrance of tubes or apertures, the electric fields will dominate the ion motion and the ions that are not near the capillary axis will tend to disperse and be lost on the walls of the capillary or aperture inlet. With this device, a higher ion population can be presented to the conductance opening at the expense of higher field ratios and higher dispersion losses inside the tube.

WO Patent 03/010794 A2 to Forssmann, et al. (2002) utilized funnel optics in front of an electrospray source in order to concentrate ions on an axis of flow by imposing focusing electrodes of higher electrical potential than the bottom of the so called accelerator device. This device frankly will not work. The ions formed by the electrospray process will be repelled by this optics configuration and little to no transmission will occur. Most of the inertial energy acquired by the ions in the source region is lost to collisions with neutral gas molecules at atmospheric pressure; consequently the only energy driving the ions in the direction of the conductance aperture will be the gas flow which under normal gas flows would be insufficient to push the ions up a field gradient. This device does not operate in fully developed flow as will be described in the present invention.

U.S. Pat. No. 6,359,275 B1 to Fischer, et al. (2002) addressed the issue of charging of the inner surface of the capillary by coating the inner surface with a conductor in the dispersive region of the tube while still keeping the benefits of the dielectric tube transport in the nondispersive region of the capillary. This approach addresses the problem of charge accumulation, but it does not remove the significant losses due to dispersion at the inlet (as shown in FIG. 8).

U.S. Pat. No. 6,486,469 B1 to Fischer, et al. (2002) utilized external electrodes and butted capillary tubes to provide enhanced control of the electric field within the capillary. This device does not (as pointed out in the preceding paragraphs) address issues related to inlet losses as presented in FIG. 8. In addition, the device still required significantly large dielectric surfaces with the associated problems of charging and contamination of the inner tube surfaces, and potential for a discharge.

U.S. Patent Application US 2003/003452 A1 and U.S. Pat. No. 6,583,407 B1 both to Fischer, et al. (2003) utilized a variety of modifications to their dielectric tube device to enhance selectivity and control of ions as they traverse their capillary device. None of these modifications addresses the aforementioned limitations of capillaries or tubes; namely loses at the tube inlet, charging and contamination of the inner tube surfaces, and potential discharge.

U.S. Pat. No. 6,455,846 B1 to Prior et al. (2002) disclosed a flared or horn inlet for introducing ions from an atmospheric ionization chamber into the vacuum chamber of a mass spectrometer. They reported that the increase in ion current recorded in the mass spectrometer was directly proportional to the increase in the opening of the flared inlet.

U.S. Pat. No. 6,897,437 to Fuhrer et al. (2005) disclosed a microchannel plate as a pressure drop and ion interface between an ion mobility spectrometer or ion drift cell at higher pressure and a chamber at lower pressure where a mass spectrometer resided. They proposed that ions would be transferred from this higher pressure region into the lower pressure region by reverse biasing the semi-conductive capillaries in the presence of gas flow and a temperature gradient as described in U.S. Pat. No. 5,736,740 to Franzen (1998), see above. No experimental results were disclosed.

U.S. Pat. No. 6,583,408 B2 to Smith et al. (2003) has recently utilized multi-capillary arrays as an inlet to their ion funnel technology. This device reports an advantage of bundle tubes over single opening conductance pathways, but fails to address the major issue relating to ion transmission loss, namely field dispersion of ions at the entrance of the conductance opening. As described above with a single tube, without controlling the field throughout the conductance path a bundle of tubes will still have significant losses when sampling higher electrical field sources.

Ion movement at higher pressures is not governed by the ion-optical laws used to describe the movement of ions at lower pressures. At lower pressures, the mass of the ions and the influence of inertia on their movement play a prominent role. While at higher pressures the migration of ions in an electrical field is constantly impeded by collisions with the gas molecules (~2 million collisions per millimeter). In essence at atmospheric pressure there is so many collisions that the ions have no "memory" of previous collisions and the initial energy of the ion is "forgotten". Their movement is determined by the direction of the electrical field lines and the viscous flow of gases. At low viscous gas flows, the ions follow the electric field lines, while at higher viscous gas flows the movement is in the direction of the gas flow. We have previously disclosed various means of moving ions at atmospheric pressure by shaping the electric field lines and directing the flow of gases. FIG. 8 illustrates a simulation of ion trajectories under the forces of both electric field and gas flow. Experimental evidence and theory support the premise that the electric field dominates the motion of ions at the entrance region of apertures and tubes of most high field sources where ions are focused at the conductance opening.

Nevertheless inlet apertures, be they tubes or pin hole apertures, heretofore known suffer from a number of disadvantages:

(a) If one uses a tube or capillary inlet to a lower pressure chamber there are loses at the entrance, along the length of the tube, and at the exit. Our U.S. Pat. No. 6,943,347 (2005) describes the use of laminated tubes to control both field and flow throughout the entire conductance pathway; from the entrance to the exit. Delaying dispersion of the ions until flow has fully developed is described in this patent as a technique to minimize dispersion losses within the conductance pathway. FIGS. 9 and 10 of U.S. Pat. No. 6,943,347 illustrated the typical flow development within a laminar flow tube and the lack of dispersion when laminated tubes are utilized to maintain uniform field throughout the tube, respectively. The principals and methods of this patent are applied to the present invention where our laminated arrays operate with the same ion transmission advantage as observed with laminate tubes.

(b) Inlet tubes made of glass offer poor transmission efficiency of gas-phase ions due to (1) loss of ions at the inlet due to the dispersive electric fields, (2) the requirement of capacitive charging of the tube leads to slow and unpredictable start-up conditions, and (3) contamination of the inner surfaces of the tube changes the capacitance of the tube leading to unpredictable transmission and possible initiation of a discharge inside the tube.

(c) Inlet tubes made of metal fair no better-loss of ions at the tube entrance and along the length of the inner surfaces due to dispersive electrical fields.

(d) Pin hole apertures also suffer from the loss of ions at the entrance due to the dispersive electrical fields.

(e) Inlet tubes made of glass are very fragile, thereby requiring special handling and storage; and the need for precautions while removing and installing the tubes.

(f) The use of arrays of inlet tubes does increase the surface area of the inlet. It does not eliminate the dispersive electrical fields present at the entrance of each individual inlet but actually multiplies the effect over a larger area.

(g) Inlet apertures made of silica or doped glass, such as microchannel plates (MCP) are generally not resistant to commonly used solvent or salts used in liquid chromatography (LC). The dielectric or silica surfaces are composed primarily of an alkali doped silica layer, and as a result, these materials are very hydroscopic (see Burle Industires, Inc. Lancaster, Pa., USA, www.burle.com). Special care and handling is necessary in order to prevent the absorption of water vapor and other components to ensure optimal performance. For example, prior to use microchannel plates are typically stored in a foil bag that has been back-filled with dry nitrogen and then evacuated. If not used, the MCP should be removed from its shipping case and the foil bag and stored in a vacuum or if vacuum storage is unavailable, storage in dry nitrogen is a suitable alternative. In addition, MCP can degrade by exposure to various types of hydrocarbon materials (such as alcohols, a common LC liquid phase) which raises the work function of the surface—causing the insulating silica layer's dielectric properties to change over time, charging of the surfaces leading to the formation of a repulsive barrier, initiating a discharge, etc. Operation in a clean vacuum environment of $10^{-5}$ torr or better is necessary in order to ensure the long-life characteristics of these devices. In addition, exposure to water can lead to swelling of the silica layers and eventually cracking or shattering of the MCP inlet; leading to a unpredictable catastrophic venting of the vacuum chamber. Damaging vital components of the analyzer, such as electronics, vacuum pumps, etc.

3. Objects and Advantages

The objective of the present invention is to maximize the transmission of ions from one pressure regime into an adjacent lower pressure region through an array of apertures in a laminated lens while minimizing the conductance of gas from the higher pressure into the lower pressure region. The relatively uniform electrostatic field through the laminated lens assures high transmission and low dispersion of the ions while in the conductance pathways of the lens. This condition does not exist in present-day ion conductance pathways in atmospheric or high pressure interfaces for mass spectrometers and will result in significantly higher ion transmission through conductance paths compared to the current art. Several objects and advantages of the present invention are outlined below.

(a) To provide an ion enrichment aperture that imparts a lower gas load on lower pressure regions while maintaining the transmission of ions. This has beneficial implications including lower requirements for pumping, power, and general size. Conversely, this device has higher transmission of ions for a given total gas load on the lower pressure region resulting in more sensitive response for ion analyzers or higher currents for current deposition processes. Utilizing small apertures in the arrays results in very low electrostatic field penetration into the lower pressure region relative to larger apertures with higher conductance.

(b) To provide an ion enrichment aperture whose array of openings is matched to the conductance pattern. A macroscopic lens can be patterned to focus the ions to a microscopic compressed pattern of conductance openings. In other words, with patterned arrays we can focus the ions to an exact pattern of conductance openings rather than being required to focus to a single opening of a tube or aperture.

(c) To provide an ion enrichment aperture with the ability to measure the transmission of ions in discrete packets, each representative of a portion of the delivered cross-section from a source of ions. With this capability we are able to independently measure each pathway to discern the cross-section composition of a source of ions. This increased information content adds an enhance dimension to analysis where composition across a cross-section may provide diagnostic, feedback, or analytical information.

(d) To provide an ion enrichment aperture with the ability to be heated and measure the temperature of the aperture. With this capability we are able to provide feedback control of the temperature of the aperture, maintaining the aperture at a prescribed temperature.

(e) To provide an ion enrichment aperture with the ability to introduce gas into the individual openings of the aperture. The gas flowing out of the openings towards the ion source, gas flowing counter to the movement of the ions, and gas flowing with the movement of the ions into the lower pressure region. With this capability we are able to use viscous forces to focus ions towards the axis of the individual openings as they enter the openings and to move ions into the lower regions. Minimizing ions impacting or depositing and contaminating the interior surfaces of the apertures, the inlet and outlet laminates; and the associated reduction in required maintenance, system drift, charging, and potential carryover from sample to sample due to deposition.

(f) To provide an ion enrichment aperture which facilitates higher transmission of ions from any number of pressure regimes, including above atmospheric pressure, atmospheric pressure, and intermediate pressures. There may be practical uses of this approach even in the millitorr region, although inertial components of motion and scattering will begin to degrade performance below about one torr.

(g) To provide an ion enrichment aperture which can be used for transmitting ions from higher pressure ion sources into lower pressure destinations. Examples of ionization sources operating at high pressures would be atmospheric pressure or intermediate pressure sources, such as but not limited to, electrospray (ES), atmospheric pressure chemical (APCI) and photoionization (APPI), inductively coupled plasmas (ICP), MALDI (both atmospheric pressure and reduced pressures), glow-discharge, RF and or DC discharges, etc. Examples of lower pressure destinations would be ion analyzers, such as but not limited to, mass spectrometers or ion mobility spectrometers, surfaces in vacuum where the deposition of thin films and etching processes are preformed, etc.

(h) To provide an ion enrichment aperture which can be produced in a variety of sizes, patterns, shapes, and materials.

(i) To provide an ion enrichment aperture which can be fabricated with a wide variety of fabrication alternatives not presently used with apertures, such as but not limited to, micro-machining; microlithography for creating patterns; etching for removing material; depositing techniques such as ion beam deposition, screen print, stenciling; printed circuit board fabrication, etc.

(j) To provide an ion enrichment aperture whose production allows for a convenient, fast, and economical change of the number of laminates, number of openings, and thickness of the individual laminates that are being produced.

Further objects and advantages are to provide an ion enrichment aperture which can be used easily and conveniently incorporated into existing atmospheric interfaces without the need for extensive or major reconstruction, which is simple to use and inexpensive to manufacture, which can be produced en masse or separately, which can be retrofitted to existing vacuum chambers or designed specifically for new vacuum chamber, which can be used with either highly dispersive, or low electrostatic or electrodynamic field ion sources, which can be used repeatedly, which is resistant to common gases and solvents used with the techniques of mass spectrometry, such as but not limited to, liquid chromatography mass spectrometry (LC/IMS), and which obviates the need for precise alignment of the ion source relative to the aperture. Still further objects and advantages will become apparent from a consideration of the ensuing description and drawings.

SUMMARY

In accordance with the present invention an ion enrichment aperture comprises a laminated lens comprised of alternate layers of insulators and metal laminates, having a plurality of openings in a prescribed pattern establishing an interface between two pressure regions.

DRAWINGS—FIGURES

Figure 7:
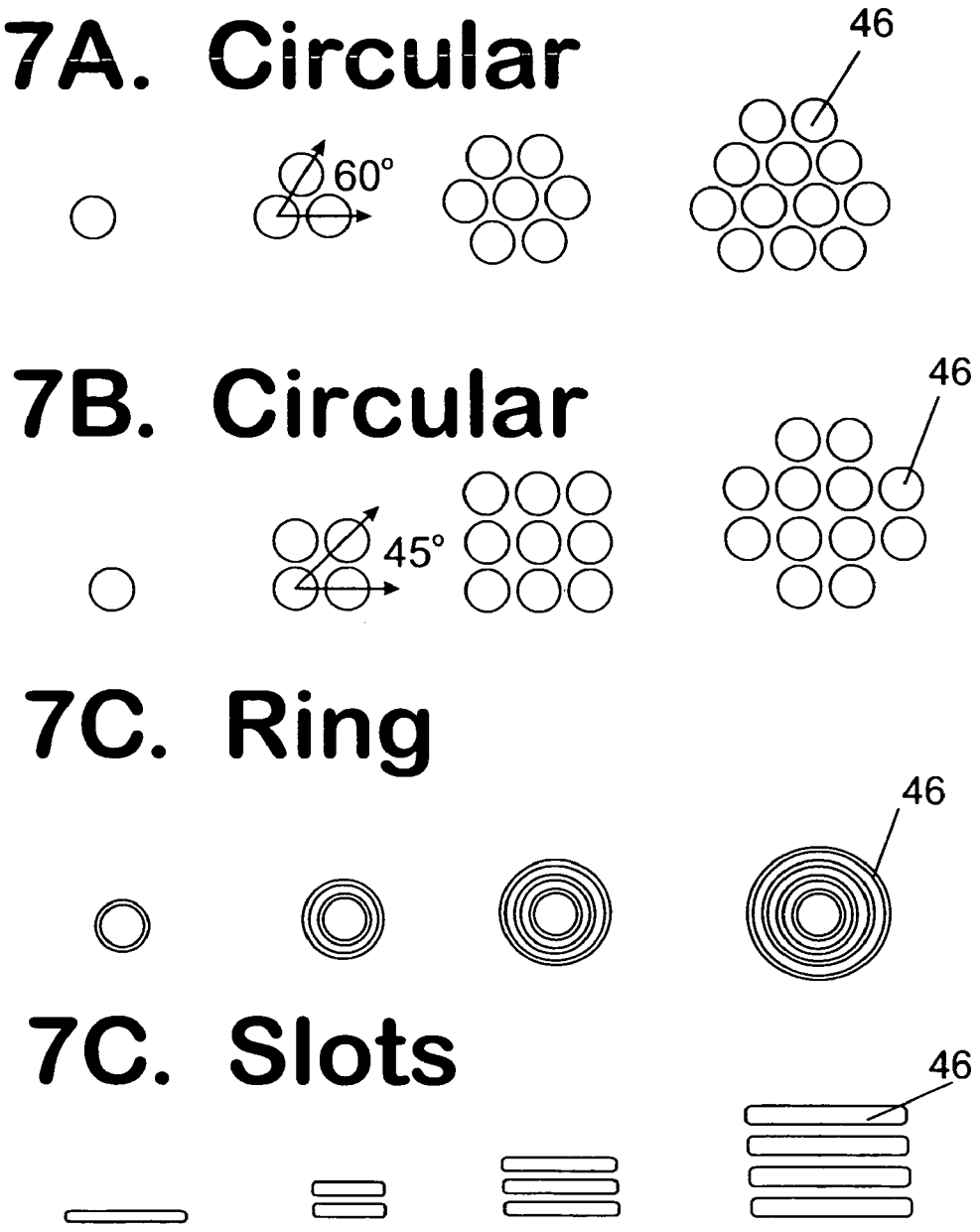

FIG. 7 shows a variety of conductance aperture arrays or patterns that may be implemented onto various embodiments of the device: A. Circular apertures with 60 degree relative orientation, B. Circular apertures with 45 degree relative orientation, C. Co-centric ring arrays, and D. Linear slotted aperture arrays.

Figure 8:
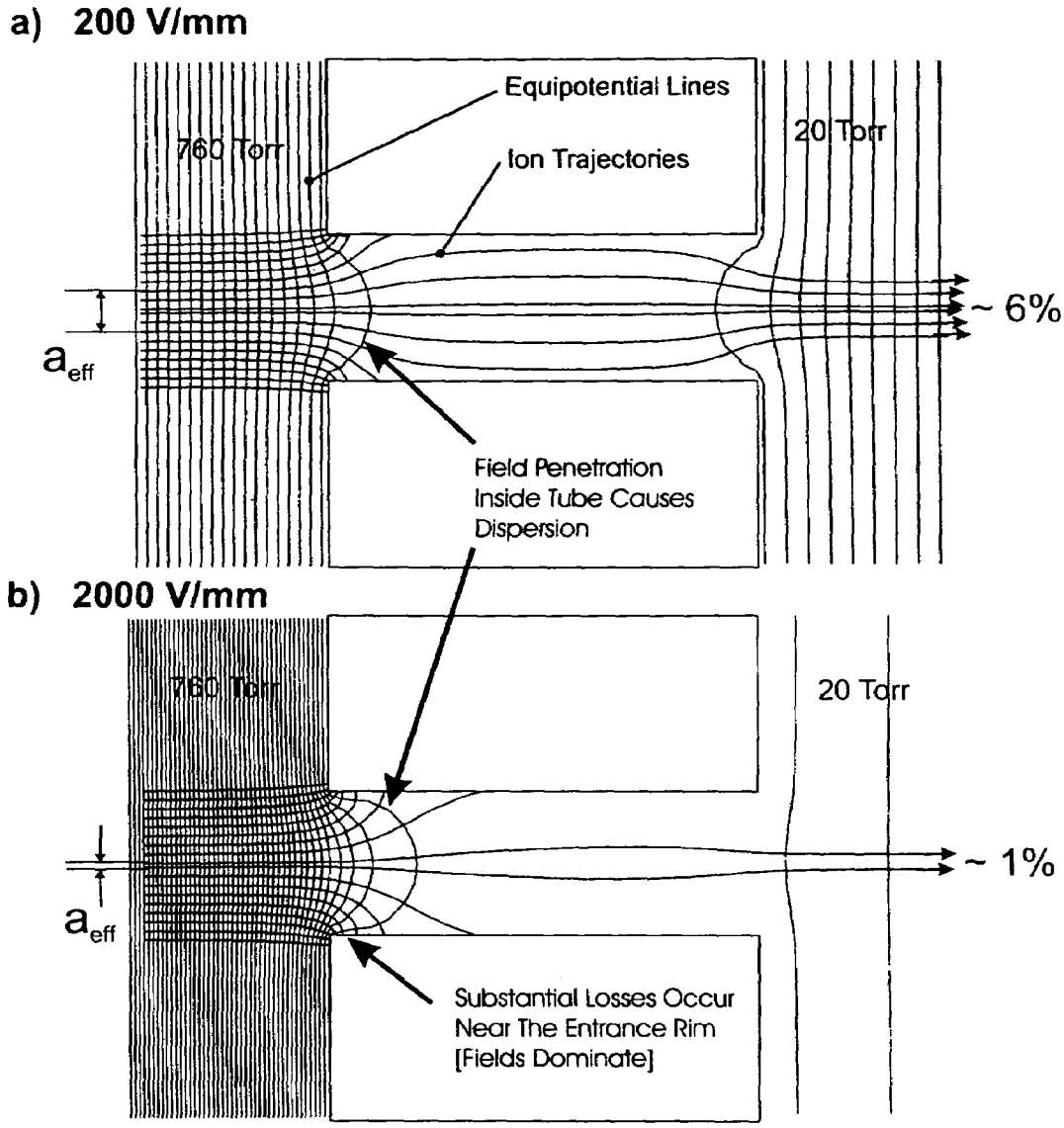

FIG. 8 shows simulated trajectories of ions showing significant dispersion at the entrance of the field-free conductance tube when entering from a (a) 200V/mm source and a (b) 2000V/mm source region. ($a_{eff}$ is the effective aperture diameter of the tube and is much smaller than the actual tube diameter for the higher field sources shown)

Figure 9:
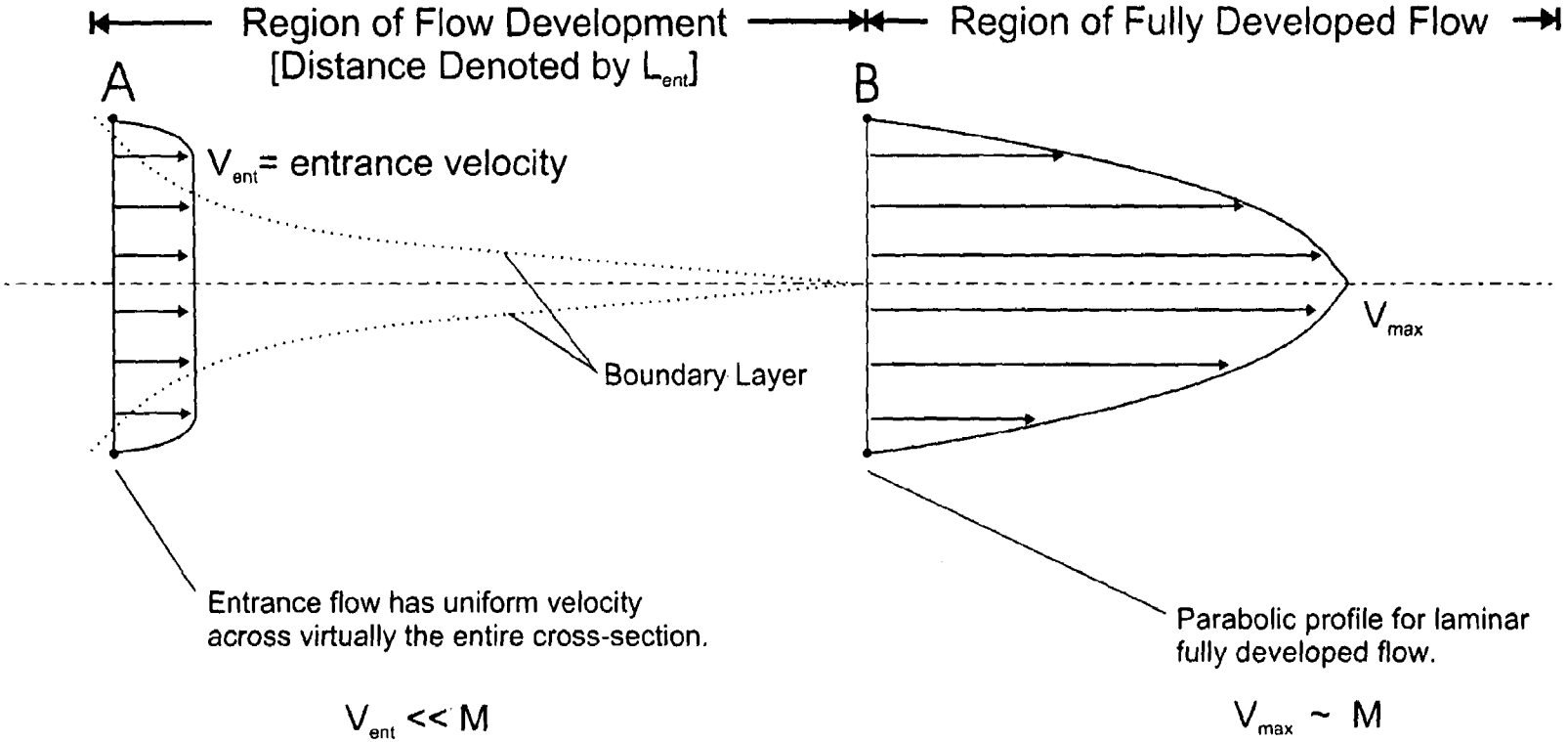

FIG. 9 shows the flow development in a laminar flow tube with planar flow at the tube entrance developing into the classic parabolic velocity profile farther down the tube. At entrance to most atmospheric pressure tube inlets, the field will dominate the motion and ions are lost to the walls of the tube.

Figure 10:
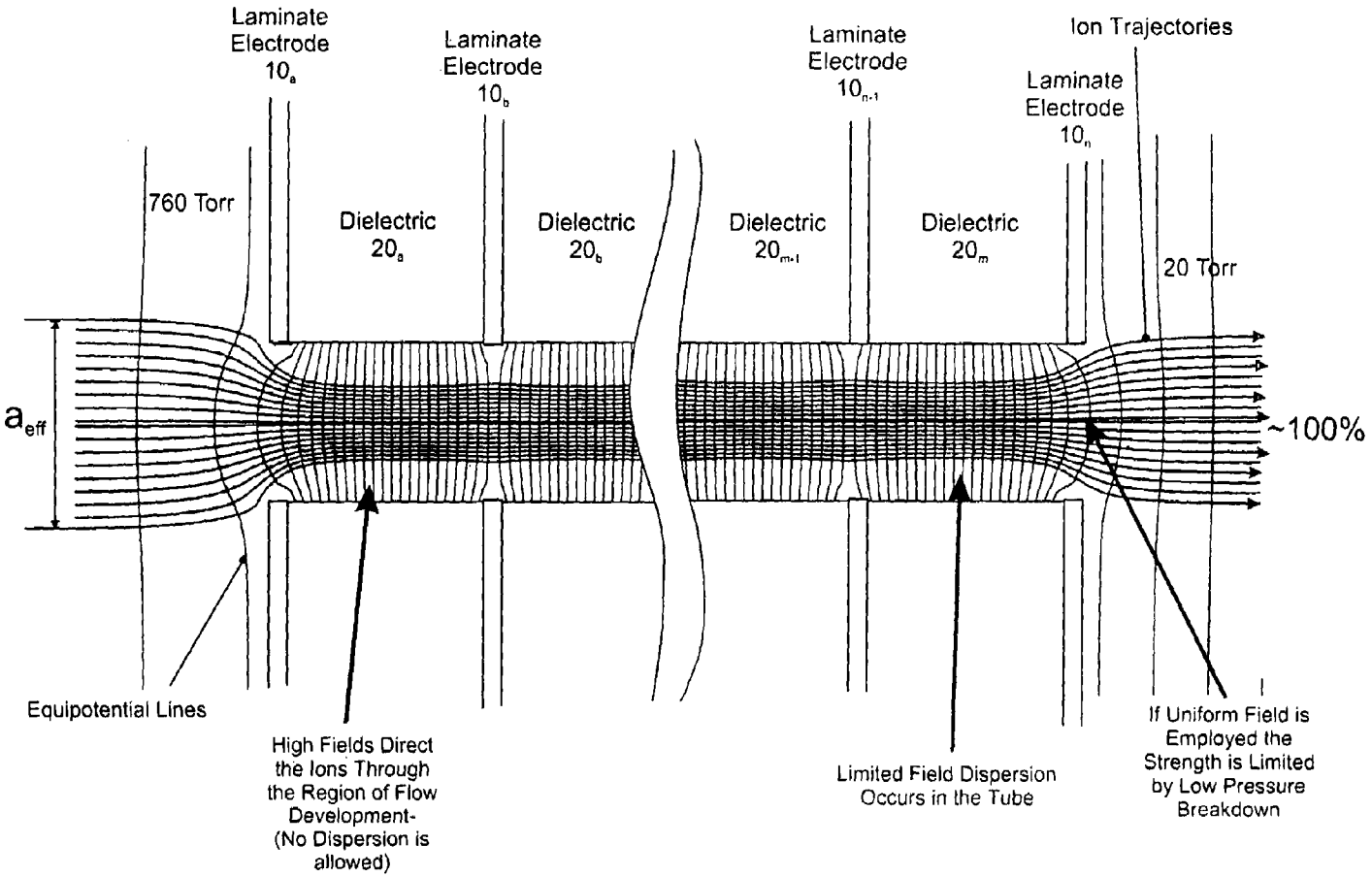

FIG. 10 shows the trajectories of ions traveling through a laminated tube with uniform through out the tube and not dispersion losses within the tube.

DRAWINGS—REFERENCE NUMBERS

10 ion trajectories

12 equipotential lines

14 ion beams

16 translational stage

20 equipotential lines

30 ion source region

32 higher pressure region

40 first metal laminate

42 voltage supply or supplies

44 first insulator laminate

46 conductance apertures

48 second metal laminate

50 higher pressure region

52 second insulator laminate

54 third metal laminate

60 chamber wall

62 O-ring

70 ion destination region

72 ion collector detector

74 multi-detector array

80 funnel region

82 high transmission element (HTE)

83 HTE apertures

84 funnel lens

85 funnel lens aperture

90 deep well region

DETAILED DESCRIPTION

Figure 1:
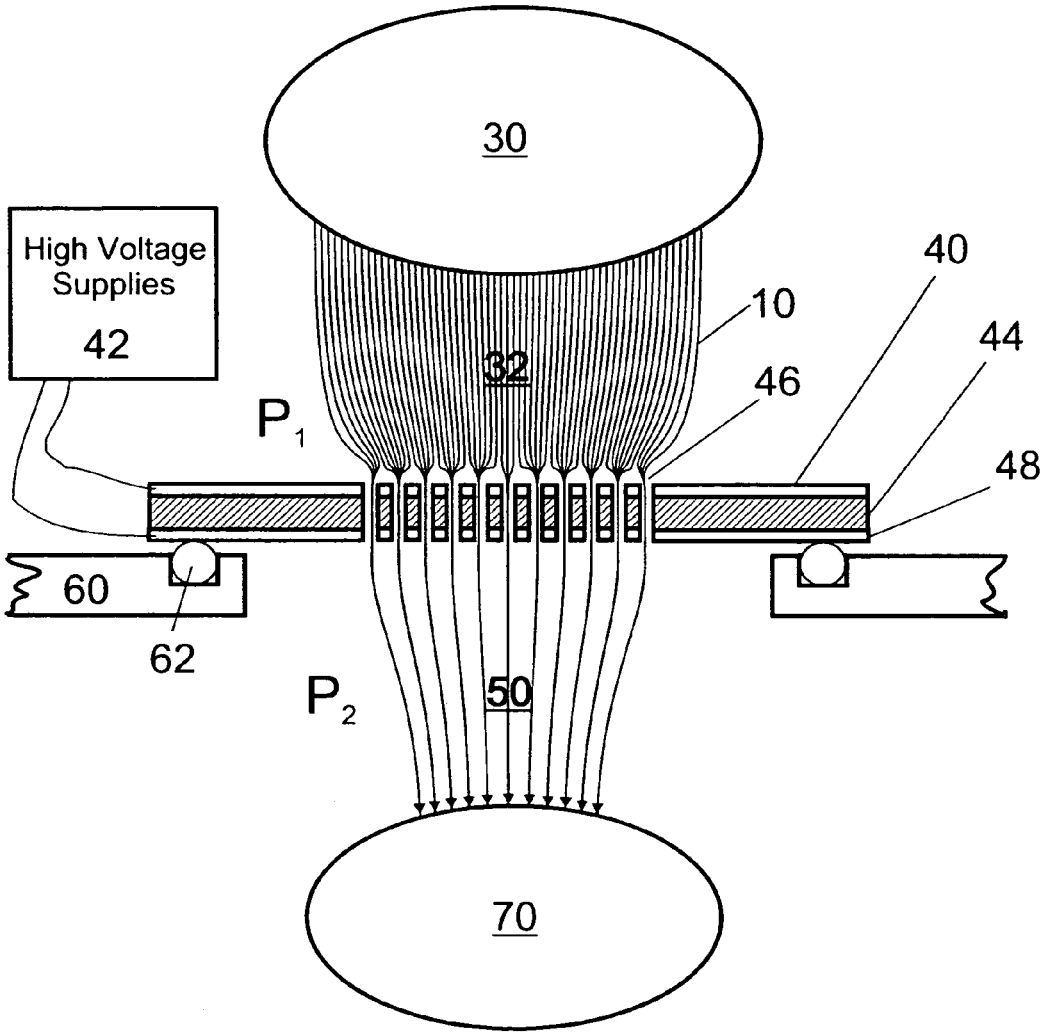
FIG. 1 shows a cross sectional view of an ion selective multi-aperture laminate according to the present invention with metal lamination on both sides.
Figure 2:
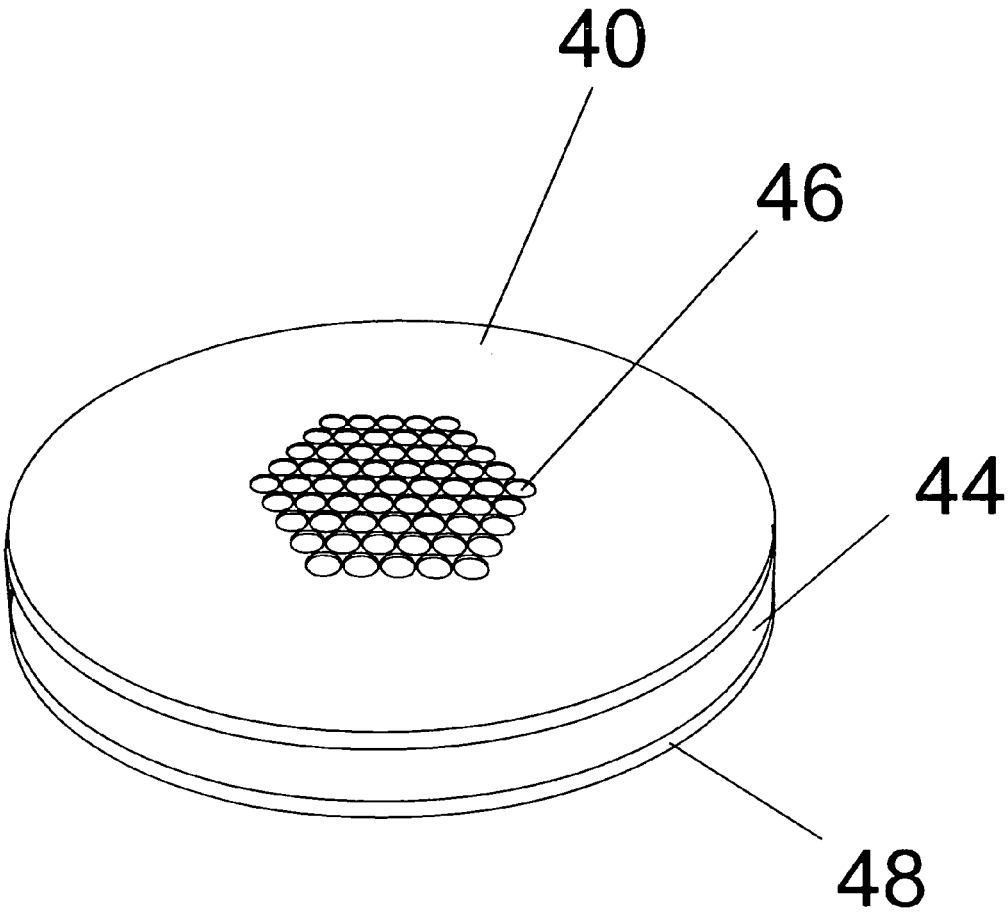
FIG. 2 shows an ion selective multi-aperture laminate disk with a metal laminate on both sides of a center insulator and circular shaped apertures.

FIGS 1 and 2—Preferred Embodiment

A preferred embodiment of the ion selective multi-aperture laminate of the present invention is illustrated in FIGS. 1 and 2. The multi-aperture laminate has a thin first insulated laminate 44 of uniform cross section consisting of an insulating material. A layer of metal 40 and 48 is laminated on both sides of the laminate 44. In the preferred embodiment, 44 is an insulating material, such as glass or ceramic. However, it can consist of any other material that can isolate electrically the two metal laminates 40 and 48 from each other, such as nylon, polyimide, Teflon, poly ether ether ketone (PEEK), etc.

The multi-aperture lens is populated with many holes or apertures 46 that traverse the lens leading from higher pressure ion collection region 32 to lower pressure region 50. The inlets of the apertures 46 are downstream of the ion source region 30 and ion collection region 32. The inlets accept ions from the region 32. The ions are transfer to the outlet of the apertures 46 and exit into the lower pressure region 50 and are collected in destination region 70.

The multi-aperture laminates rest on an O-ring 62 which isolate the metal surface 48 from the chamber wall 60. In the preferred embodiment, the wall is the vacuum chamber of a gas-phase ion detector, such as, but not limited to a mass spectrometer. The O-ring also serves as a vacuum seal. The wall is made of an insulating material, such as, polyimide or glass. However, the wall can consist of any material that can contain a low pressure, such as, nylon, polycarbonate, ploy ether ether ketone (PEEK), stainless steel, aluminum, etc.

The metal laminates may be deposited on the base by vapor deposition and the holes or apertures formed by ablating away the metal and base using a laser. Alternatively the multi-aperture lens may be manufactured by using the techniques of microelectronics fabrication: photolithography for creating patterns, etching for removing material, and deposition for coating the surfaces with specific materials.

The multi-aperture laminate is typically 1 mm to 3 mm in thickness, and has overall dimensions roughly 30 mm×30 mm (square shape) to a diameter of roughly 30 mm (circular shaped). The apertures of the lens are circular in shape as shown in FIG. 2. In other embodiments, the apertures can be but not limited to rectangular or oblong shapes. FIGS. 7 A through D show a variety or proposed conductance aperture array patterns that can be oriented to provide high collection and low relative conductance. The simplest laminate is a single aperture. We can increase the number of apertures and decrease the diameter of individual holes in order to reduce overall conductance. The smaller the aperture size, the higher the demand on and requirement for micro-fabrication techniques. Precise tolerances on laminate structures and apertures can be obtained into the sub-micron dimensions. In general, the smaller the apertures the lower the gas conductance with resulting higher ion flux across the lens.

Figure 3:
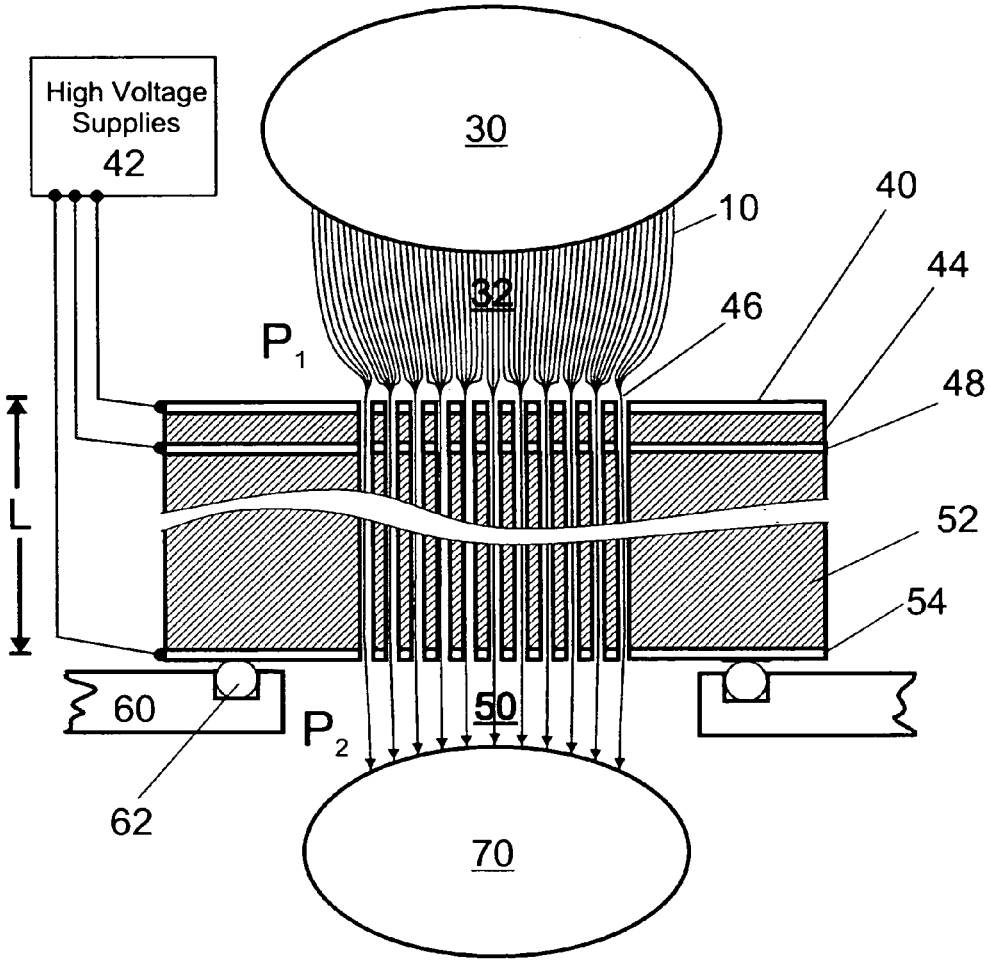
FIG. 3 shows a cross sectional view of an ion selective multi-aperture device with an additional laminate of metal downstream to allow for the establishment of tubular rather than aperture gas flow conditions.

FIG. 3—Additional Embodiments

There are various possibilities with regard to the number and type of laminates that can make up the laminated multi-aperture lens. FIG. 3 shows a cross-sectional view of multi-aperture lens made up of numerous laminates. Besides the insulating base 44 and metal laminates 40 and 48, an additional insulating layer 52 is laminated onto the exposed surface of the metal laminate 48 while a third metal layer 54 is laminated onto this second insulating laminate. Alternatively, the laminated multi-aperture lens can be configured without the third metal laminate. This increased length of the conductance apertures in this embodiment results in different conductance properties (tube vs. pinhole) which has advantages for some applications (L is the length of the conductance tube).

Figure 5A:
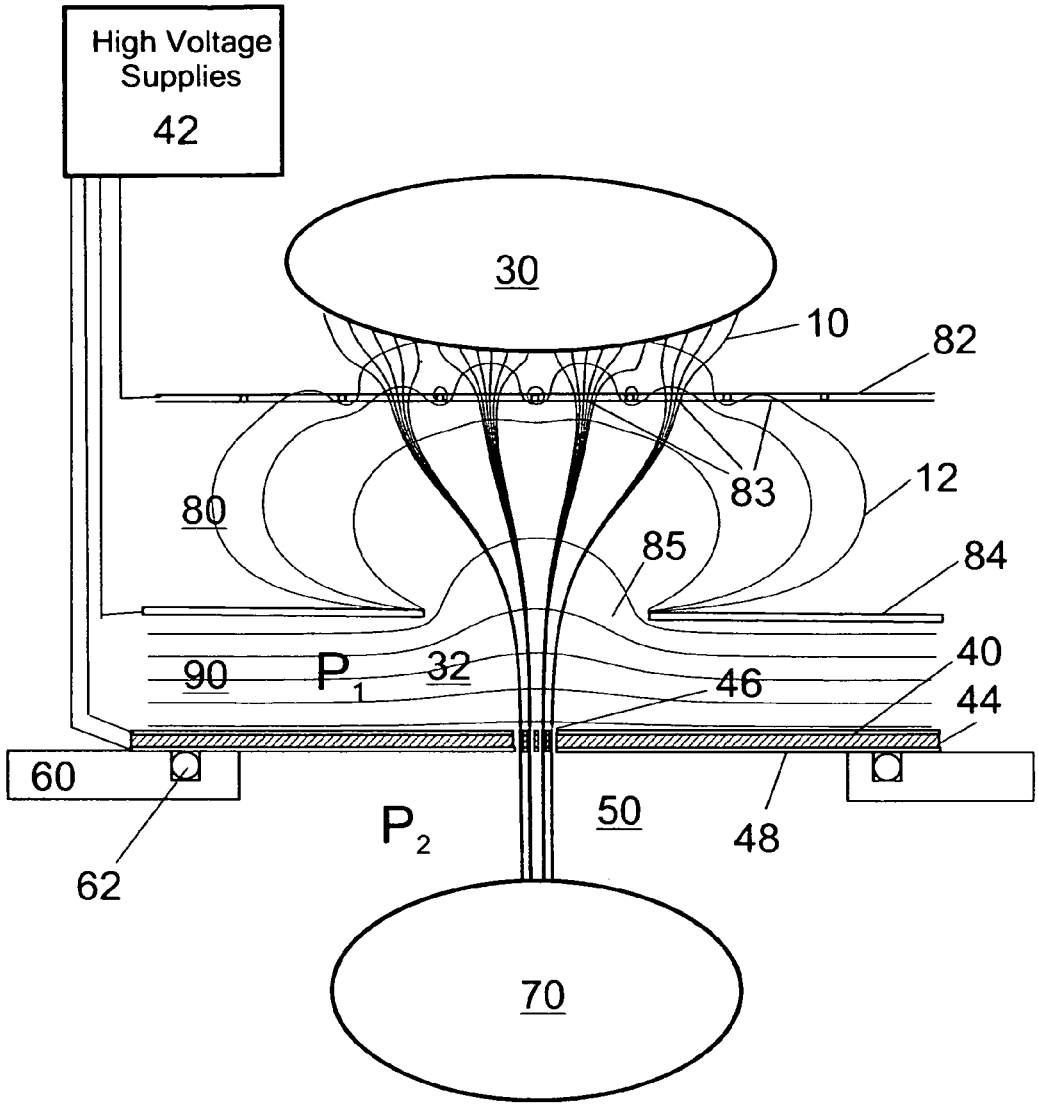
FIG. 5A shows a cross sectional view of a multi-aperture device with the compression of the ions into ion beams occurring remotely from the conductance aperture. In this embodiment there is an additional ion optical compression of the ion beam onto a smaller array of conductance apertures.
Figure 5B:
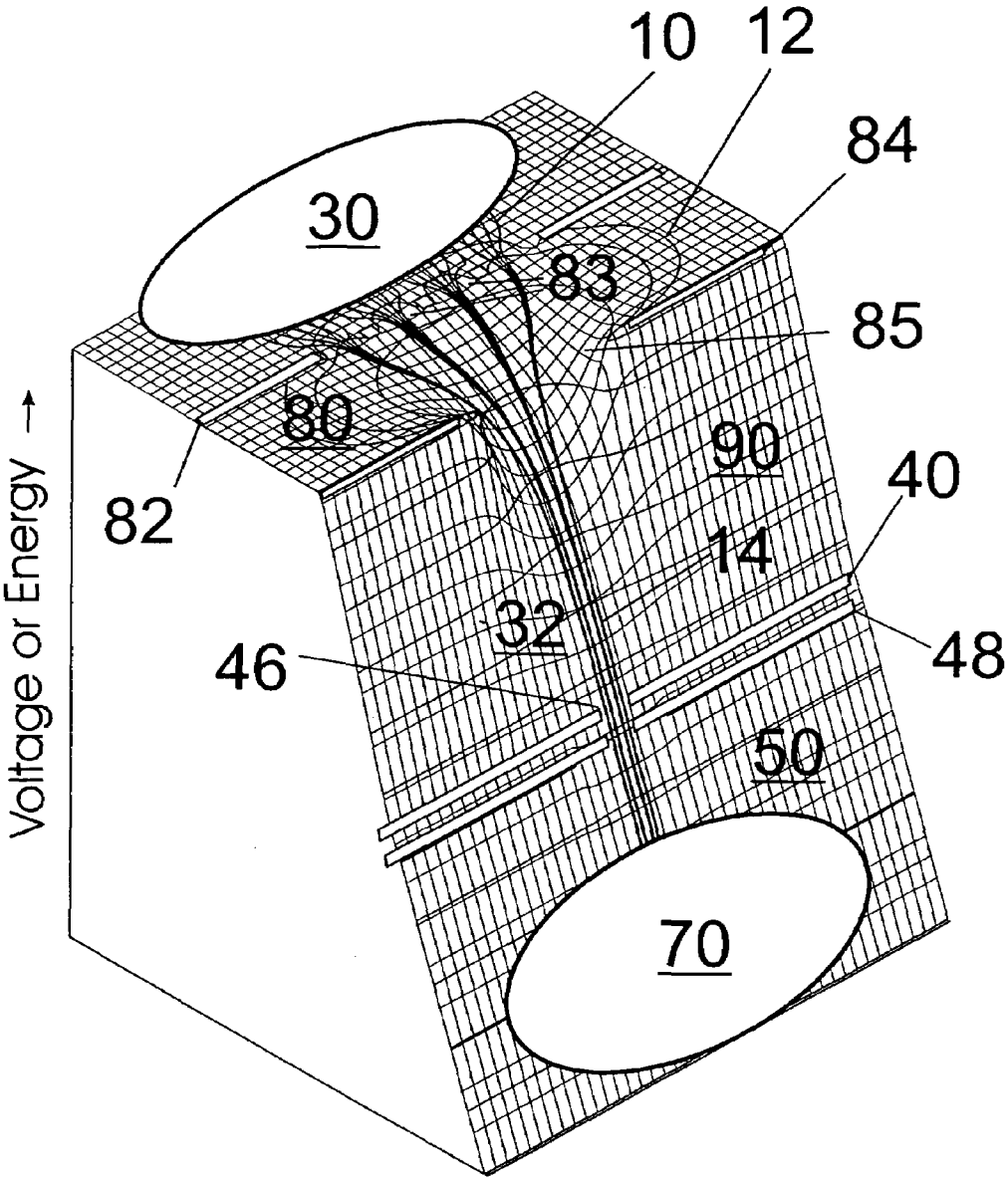
FIG. 5B shows a potential surface of the device shown in FIG. 5A.
Figure 6:
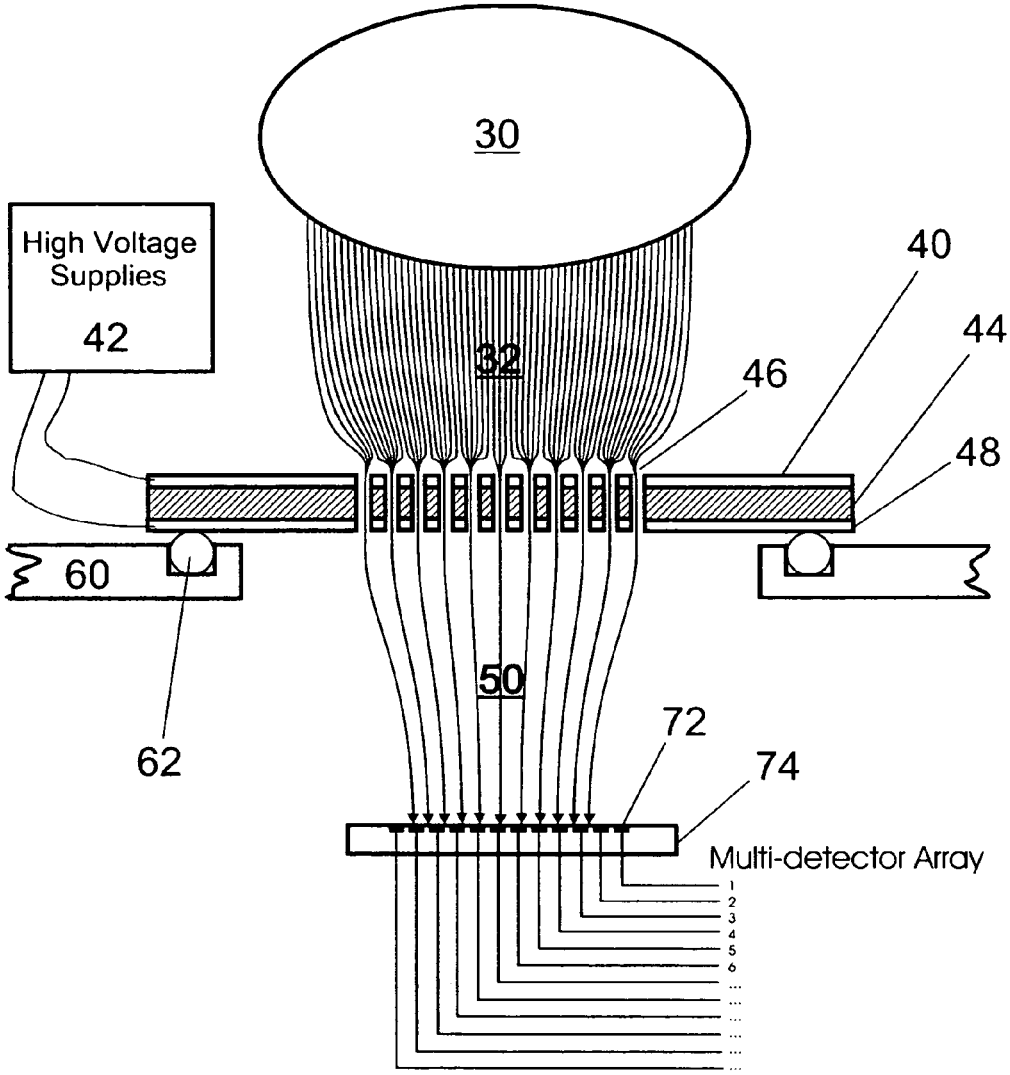
FIG. 6 shows a similar cross sectional view of a multi-aperture lens directing ions onto a multi-detector array.

FIGS. 4, 5, 6—Additional Embodiments

Figure 4A:
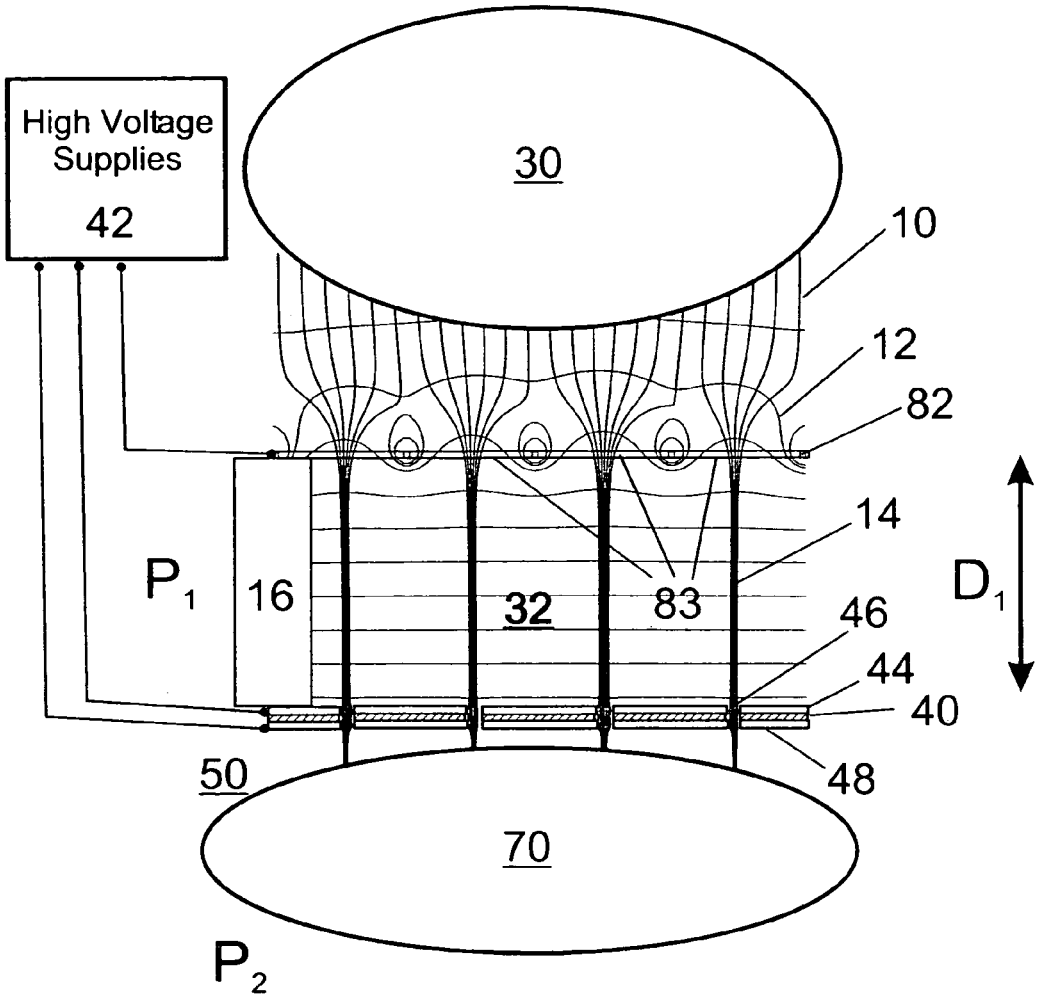
FIG. 4A shows a cross sectional view of a multi-aperture device with the compression of the ions into ion beams occurring remotely from the conductance aperture.

One additional embodiment seen in FIG. 4A introduces an additional high transmission surface 82 which is a patterned and perforated metal element that allows the compression of ions to occur remotely from the conductance apertures 46 (destined by $D_1$, distance between surface 82 and metal laminate 40). Because the compression of a dispersed ion population from region 30 occurs some distance away from the conductance apertures, mechanical alignment may be required to line the beams with the apertures. One method would be electromechanical translational stages 16.

Another additional embodiment seen in FIG. 5A introduces an additional high transmission surface 82 (at a distance of $D_2$) and an additional funnel lens 84 to allow further compression of the patterned ion beams into a smaller cross section bundles of ion beams that are directed at a smaller more condensed patterned arrays of conductance apertures. The patterned ion beams can be exactly matched to the patterned arrays of conductance apertures to maximize ion transmission through a minimum conductance cross-section.

An additional embodiment is shown in FIG. 6; a cross sectional view of the ion selective multi-aperture lens is shown. FIG. 6 shows an arrangement as in FIG. 1, however the multi-aperture lens is positioned upstream of a multi-detector array 74, individual ion streams 56 exiting the apertures 46 can be focused onto discrete collector electrodes 72, these discrete collectors being electrodes in a micro-channel plate or a multi-anode as described in U.S. Pat. No. 5,777,326 to Rockwood et al. (1998). In other embodiments, the laminated multi-aperture lens can serve as a means of introducing ions at or near atmospheric pressure into a mass spectrometer equipped with a high pressure interface for the introduction of ions into the mass analyzer.

Operation—FIGS 1, 2

The manner of using the multi-aperture laminate to introduce ions from atmospheric pressure ion sources (API), such as but not limited to, electrospray, atmospheric pressure chemical ionization, or inductively coupled plasma ion sources into a vacuum system is as follows. Ions at or near atmospheric pressure in the ion source region 30 are directed towards the metal surface 40 along the lines of the electrical force fields. Near the metal surface the ions are focused into the inlets of the apertures 46 by following the electrical force fields emanating outward toward the ion source region 30. At the same time they are entrained for the most part by the gas also entering the inlets of the apertures from region 32 and transferred through the aperture into the low-pressure region 50 and collected in region 70 (as shown in FIG. 1). Through suitable potentials at the ion source region 30, metal surfaces 40 and 48, and region 70, the electrical force fields are formed. For positive ions, typically the metal laminate 40 is at ground potential while the electrical potential of the metal laminate 48 is selected to cause the electrical field lines emanating from the apertures to be converging into the inlet of the apertures. Region 70 is at a lower potential relative to metal laminate 48. The exact potentials will depend on the thickness of the base 44, the metal laminates 40 and 48; and the diameters of the apertures. The conditions for ion transmission are that the electric fields inside of the conductance pathway between the metal laminates must be substantially higher than the electric field in the collection region 32. Under these conditions, ions will compress into the cross section of the apertures 46 from the entire incident surface of ions. Another important condition of operation is that the electric field within the conductance pathway (i.e. between the inlet and outlet of 46) must be fairly uniform to prevent ions entering the aperture from dispersing to the walls of the opening. This will result in charging of surface. Ions are swept through the conductance pathway without appreciable radial dispersion by either electric field or viscous flow.

It should also be noted that the operation of these ion selective aperture array may occur across any number of pressure differentials, including, but not limited to atmospheric pressure (AP) to first pumping stage in mass spec; above AP to AP for high pressure applications; and first pumping stage (~10 Torr) to second stage (~0.1 Torr) in a differentially pumped vacuum system. One important operating boundary will be the discharge limit associated with any given pressure regime. Obviously, we are limited to lower electrostatic field strengths for compression when operation at the minimum of the Paschen Curve.

It is generally anticipated that the relative pressure between region 32 and region 50 are at least a factor of two although, factors of 10 or more can be obtained with increased pumping (with vacuum destinations) or increased pressure source with above atmospheric pressure sources.

Operation of Additional Embodiments—FIG 3

The aperture length L of the present device may be increased by the addition of insulated laminate 52 and addition metal laminate 54. The conductance pathway in this device is operated under the conditions of tube flow which decreases the conductance for a given cross sectional area of the collective apertures 46.

In general, the operation of the embodiment illustrated in FIG. 3 is the same as FIG. 1 with the downhill (in terms of electrostatic field) flow of ions from source 30 into collection region 32. The electrostatic field penetration from inside the laminate apertures 46 reaches out and focusses ions from region 32 into the laminate apertures 46.

It is anticipated that the electrostatic field down the entire length of L should be kept fairly uniform under normal operation. Slightly dispersive fields may be overcome with the viscous flow within the tube as described in our co-pending patent (U.S. Patent Application 60/419,699).

Operation of Additional Embodiments—FIGS 4, 5, 6

Figure 4B:
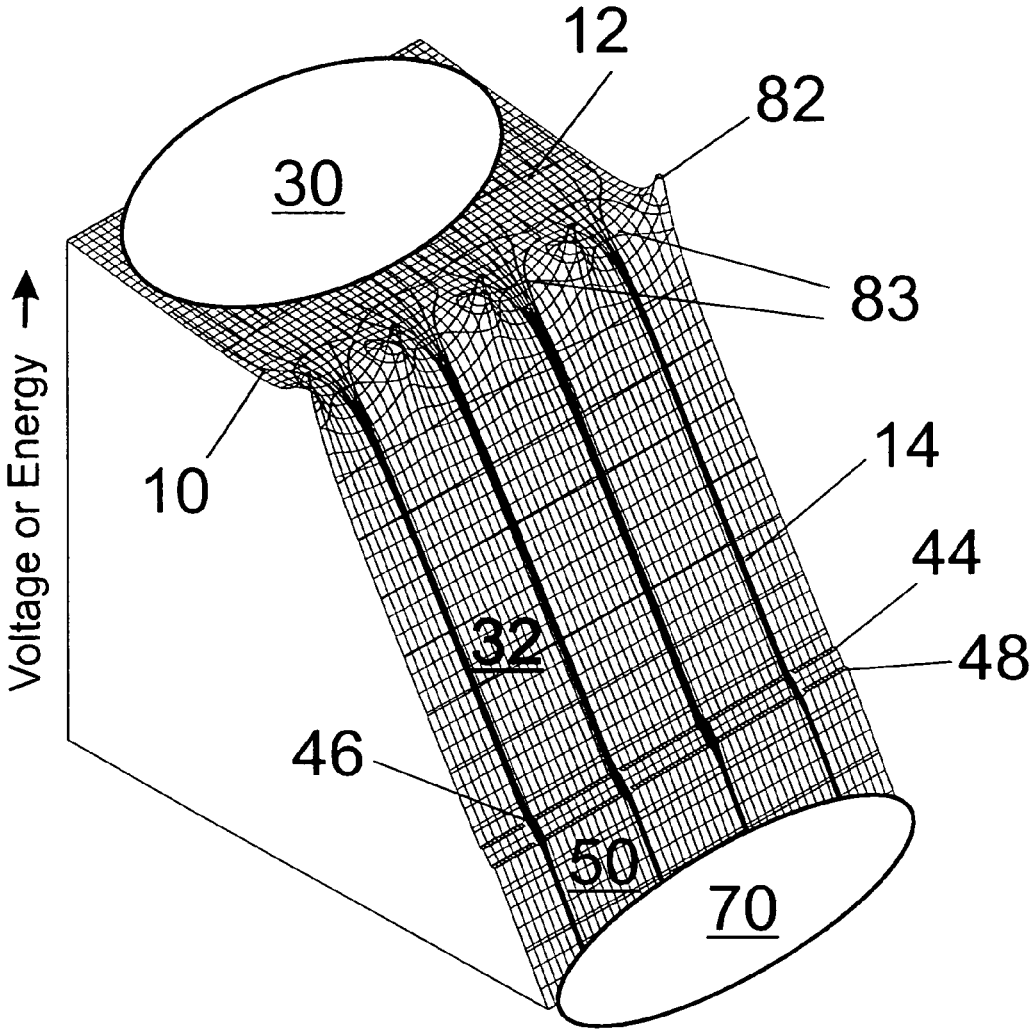
FIG. 4B shows a potential surface of the device shown in FIG. 4A.

FIGS. 4A and 4B are operated in a different mode compared to previous embodiments in that the ion compression occurs remotely (distance D1) from the pressure reduction. The addition of a high transmission element 82 with arrays of openings 83 upstream from the conductance laminate openings 46 results in the compression of the ion population from source 30 into collimated ion beams 14 due to a significant field ratio across element 82. The beams 14 traverse region 32 toward the laminated surface in relative straight lines due to the uniform field in region 32.

Key to operation of this embodiment is the precise alignment of the ion beams 14 with the conductance apertures 46 in the laminated surface. We envision that this alignment requires that the apertures 83 be aligned electro-optically with aperture 46. This can be accomplished with high precision assembly or x-y translational stages 16. These can be controlled and manipulated with verniers or stepper motors. Detectors (as illustrated in FIG. 6) can also be used to measure optimal current in the low pressure region and computer data collection, feedback, and control can be implemented.

FIG. 4B illustrates the potential surface that the ions traverse traveling from region 30 to region 70. Note that the relative voltages applied to metal elements 82, 44, and 48, as well as the destination 70 potential are adjusted so that field is fairly uniform the entire distance from the high transmission element 82 to the ion destination 70. One important operational limitation is the electrostatic discharge or breakdown of gases, particularly at lower pressures. Also note the penetration of the electric field across element 82. Some details of operation of an array of apertures 82 of this type are described in U.S. patent application Ser. Nos. 09/877,167 and 60/384,869, both to Sheehan and Willoughby.

In some implementations of the present device, some dispersion will be tolerated at the low pressure side. Such as, when the destination region is the entrance of a radio frequency (RF) ion guide. When the ions are introduced into the entrance of the RF ion guide they would be refocused on-axis by means of collisional damping in the pseudo-potential well of the ion guide.

FIGS. 5A and 5B are operated in a different mode compared to previous embodiments in that the ion compression occurs remotely (distance $D_2$) from the pressure reduction. The addition of a high transmission element 82 with arrays of openings 83 upstream from the conductance laminate openings 46 results in the compression of the ion population from source 30 into collimated ion beams 14 due to a significant field ratio across element 82. In this embodiment the ion beams 14 traverse region 90 through the funnel lens aperture 85 toward the laminated surface in curved trajectories due to the funnel shaped electrostatic fields in funnel region 80 established by funnel lens 84. Resulting in further focusing the aggregate of ion beams onto a smaller cross-sectional area at the array of apertures 46 on the laminated surface.

As with FIG. 4 the key to operation of this embodiment is the precise alignment of the ion beams 14 with the conductance apertures 46 in the laminated surface. We envision that this alignment requires that the apertures 83 be lined up electro-optically with aperture 46. This can also be accomplished with high precision assembly or x-y translational stages 16 or feedback control coupled with ion detectors. Note that alignment with this "double focusing" device will require more precision both spatially and electro-optically.

FIG. 5B illustrates the potential surface that the ions traverse traveling from region 30 to region 70. Note that the relative voltages applied to metal elements 82, 84, 44, and 48, as well as the destination 70 potential are adjusted so that field is fairly uniform the entire distance from the high transmission element 82 to the ion destination 70. One important operational caution is the restriction of the discharge or breakdown, particularly at lower pressures. Note the focusing fields of the funnel region 80 coupled to the deep well region 90.

In some implementations of the present device, some dispersion will be tolerated at the low pressure side as outline in FIG. 4 with RF ion guides. Alternatively, region 70 may be an intermediate pressure reduction stage containing a skimmer as part of electrostatic lens elements to focus and collect ions exiting the apertures 46 of the multi-aperture lens into region 50.

As shown in FIG. 6, when the metal laminated multi-aperture lens is positioned in front of a multi-detector array 74, individual ion streams 56 exiting the outlets of the apertures can be collected at discrete collector electrodes 72, such as but not limited to, micro-channel arrays or multi-anodes as described in U.S. Pat. No. 5,77,326 to Rockwood et al. (1998).

Conclusion, Ramifications, Ans Scope

Accordingly, the reader will see that the ion enrichment aperture arrays of this invention can be used to introduce gas-phase ions and charged particles into lower pressure regions, such as the vacuum chamber of a mass spectrometer, without imparting large gas loads on the vacuum system; can be used to accept and pass into a lower pressure region an incident ion beam with a prescribed pattern; and can be used to sample an ion beam of whose cross-section is many times the cross section of the individual openings of the ion enrichment aperture. In addition, when an ion enrichment aperture array is used in conjunction with our high transmission lens, laminated or unlaminated, dispersive plasma of gas-phase ions and charged particles can be sampled and introduced into lower pressure regions without imparting a large gas load on the vacuum system. Furthermore, the ion enrichment aperture has the additional advantages in that:

it permits the production of ion enrichment apertures in a variety of shapes tailor make for a specific ion source;

it permits the production of ion enrichment apertures with a predetermined number and layout or pattern of openings, spacing between openings, shape of openings, etc. tailor made for maximum ion transmission and minimal gas load on the lower pressure region;

it allows the sampling of wide incident ion beams, 1–3 mm wide, without the associated gas load that an aperture 1–3 mm wide would impart on the lower pressure region.

it provides an ion enrichment aperture were the electric fields in front of the aperture are controllable and can be varied depending on type of ion source, ion detector or analyzer in lower pressure region, and pressure across inlet aperture.

it provides an ion enrichment aperture which is easily identifiable by the predetermined pattern of openings and overall shape of the aperture array; therefore identifying which ion source and/or analyzer it is intended for, which application it is used with, whether it disposable, reusable, etc.

it allows the ion enrichment aperture to be manufactured by the same means as printed circuit boards—laying down the individual laminates; providing inlet arrays of varying thickness and assemblies of different shapes; laying out openings in prescribe patterns; incorporating gas fixtures for gas inlets; incorporating heating elements and temperature sensors, flow meters, amperage meters, electrical leads for such components, etc.

it provides an ion enrichment aperture which will not be prone to breakage when handled or installed, the laminates themselves providing a strong and rigid structure.

it provides an ion enrichment aperture with a superior composition that is resistant to commonly used liquid chromatographic mobile solvents and salts.

it provides an ion enrichment aperture with a superior composition that is resistant to commonly used gases in atmospheric, above atmospheric, and sub-atmospheric pressure interfaces to lower pressure analyzer chambers.

it provides an ion enrichment aperture that is inexpensive to manufacturer and therefore potentially disposable.

Although the description above contain many specifications, these should not be construed as limiting the scope of the invention but as merely providing illustrations of some of the presently preferred embodiments of this invention. For example, the lens can have other shapes, such as circular, oval, triangular, etc.; the openings can have other shapes; insulator and metal laminates can be manufactured by using the techniques of microelectronics fabrication (vacuum or higher-pressure methods), photolithography for creating patterns, etching for removing material, and deposition for coating the insulating base with specific materials; the number of laminates, the relative thickness of adjacent laminates and the size and shape of the individual openings can vary depending on the source of ions, the type of ion collection region, the pressure drop across the lens or a combination of all three, etc.

Thus the scope of the invention should be determined by the appended claims and their legal equivalents, rather than by the examples given.

The invention claimed is:

1. Apparatus for the selective transmission of gas-phase ions or charged particles from a higher pressure region into a lower pressure region, the apparatus comprising:

a. a source of ions in said higher pressure region;

b. a laminated interface populated with a plurality of openings forming an barrier between said higher and lower pressure regions through which said ions pass unobstructed, said interface comprised of alternating layers of metal and insulating laminates, with metal laminates on the top-side and bottom-side of said laminated interface, said metal laminates being supplied with individual attracting electric potentials by connection to a voltage supply generating an electrostatic field between said source of ions in said higher pressure region and said interface; and c. a destination in said lower pressure region having a lower electric potential than said interface, said destination is adjacent to said metal laminate on the underside of said lens, for receiving ions:

wherein said interface is a selective and controllable barrier for the passage of said ions from said higher and lower pressure regions.

2. The apparatus of claim 1, wherein said higher pressure region is at, near, or above atmospheric pressure.

3. The apparatus of claim 2 wherein said ion source region at, near, or above atmospheric pressure is comprised of an electrospray, atmospheric pressure chemical ionization, laser desorption-ionization, photoionization, discharge ionization, glow discharge, inductively coupled plasma ionization sources, or a combination thereof.

4. The apparatus of claim 1, wherein said lower pressure region is greater than 1 torr, whereby motion of said ions is at least partially influenced by viscous flow.

5. The apparatus of claim 1, wherein said source of ions in said higher pressure region is comprised of an incident beam of ions from an array of capillaries, an ion optics assembly, a high-transmission perforated surface, optical lens with electro-mechanical translational stages, RF or RF-DC multi-pole or multi-plate assemblies, or combinations thereof.

6. The apparatus of claim 1, wherein said destination in said lower pressure region is comprised of an array of capillaries, an ion optics assembly, RF or RF-DC multi-pole or multi-plate assemblies, tesselated ion detector, a mass analyzer, low-pressure ion or particle detector, or combinations thereof.

7. The apparatus of claim 1, wherein said laminated interface is populated with openings having a prescribed pattern.

8. Method for the selective transfer of gas-phase charged particles, ions, or combination thereof from an ion source at or near atmospheric pressure and focusing approximately all said charged particles or ions into a lower pressure region, the method comprising:

a. providing electric urging to said ions from said ion source with electric fields provided by a laminated interface of the type comprising alternating layers of insulating and metal laminates having metal laminates on topside and underside of said interface, said interface populated with openings having a predetermined pattern that are contiguous with said laminates, said metal laminates having ion drawing electric potentials such that electric field lines between said ion source and said laminated interface are concentrated into said openings; and b. providing electric urging from said lower pressure region and viscous flow to said ions as they exit said openings such that both electric field and viscous or stream flow lines are directed into lower pressure region;

whereby approximately all said ions are transferred from said ion source at or near atmospheric pressure into said lower pressure region through said openings for ion detection, ion mobility or mass spectral analysis, or combination thereof.

9. The method of claim 8, wherein providing the transfer of said ions at or near atmospheric pressure into lower pressure region, said laminated interface is comprised of an insulating base, said insulating base is sandwiched between and is contiguous with said metal laminates on topside and underside of said interface, said metal laminate on said topside is downstream of said ions source at or near atmospheric pressure, while said metal laminate on said underside is upstream or contiguous with lower pressure region, whereby approximately all said ions are transferred or not transferred through said openings into lower pressure region by adjusting electrostatic urging, direct current (DC), of said central metal laminate.

10. The method of claim 8, wherein providing the transfer of said ions at or near atmospheric pressure into lower pressure region, said laminated interface is comprised of a central metal layer or laminate having a topside and underside, said central metal laminate has a layer of insulating material laminated on said topside and underside of said central metal laminate that are contiguous with said central metal laminate, in addition said insulating laminates are contiguous with said metal laminates on topside and underside of said interface, whereby a substantial fraction of said ions are transferred or not through said openings into lower pressure region by adjusting said electric urging, direct current (DC), varying current (RF), or a combination thereof, of said central metal laminate.

11. Method for increasing the conductance of charged particles or ions or combination thereof from a high pressure ion source through a series of parallel openings into a lower pressure region, the method comprising:

a. providing a electric urging to said ions from said ion source with electric fields provided by a laminated interface of the type comprising alternating layers of insulating and metal laminates having metal laminates on topside and underside of said interface, said interface populated with a prescribed predetermined pattern of said parallel openings contiguous with said laminates, said metal laminates having ion drawing electric potentials such that electric field lines between said ion source and said laminated interface are concentrated into said openings;

b. providing electric urging from said lower pressure region and concurrent viscous flow to said ions as they exit said openings into lower pressure region such that both electric field and viscous or stream flow lines are directed into said lower pressure region; and c. maintaining said lower pressure region at or near atmospheric pressure but not less than 1 torr;

whereby approximately all said ions are transferred from said high pressure ion source into said lower pressure region while limiting the conductance of gas from said high pressure source through said openings into lower pressure region.

12. The method of claim 11 wherein said lower pressure region is comprised of ion optic assemblies, RF multi-pole or multi-plate assemblies, an ion mobility or mass spectrometer, or combination thereof.

13. The apparatus of claim 1, wherein said metal laminates on top-side and bottom-side are further comprised of individual and discrete electrodes, said electrodes being supplied with individual electric potentials whereby electrical fields at said openings on top-side of said interface urge said ions into said openings from said higher pressure region and electrical fields at said bottom-side of said interface urge said ions out of said openings, away from said bottom-side, into said lower pressure region.

14. The apparatus of claim 1, wherein said individual laminates disposed between said topside and bottom-side metal laminates are further comprised of controllable means, sensing means, and combination thereof imbedded in said interface and connected to a controller whereby said controllable means collectively or individually control or sense the passage of ions from said higher pressure region into said lower pressure region.

15. The apparatus of claim 14, wherein said controllable or sensing means are comprised of metal laminate(s) consisting of individually addressed electrodes, heaters and temperature sensors, flow meters, current meters, gas inlets, and combinations thereof.

16. The method of claim 8, wherein providing the transfer of said ions at or near atmospheric pressure into lower pressure region, said laminated interface is further provided with controlling and sensing means, whereby the temperature of said interface is controlled, the gas flowing out into said lower pressure region is recorded and metered, the passage of said ions is recorded and metered, and combination thereof.

17. A method for the selective transfer of gas-phase ions, charged particles, and combination thereof, the method comprising:

a. transferring substantially all said gas-phase ions from a higher pressure region across a perforated electrically conducting barrier into a lower pressure region; and b. conducting a reduced flow of neutral gas species from a higher pressure region across a perforated electrically conducting barrier into a lower pressure region, whereby the relative concentration of ions compared to neutrals is substantially higher in said lower pressure region compared to the relative concentration in said higher pressure region.

18. The method for the selective transfer of gas-phase ions, as described of claim 17, further including the step in said lower pressure region of providing electric urging, a gas flowing concurrent to the passage of said ions, and combination thereof, directing said ions away from said barrier and towards a collector or analyzer.

19. The method for the selective transfer of gas-phase ions, as described of claim 17, further including analyzing said ions in said lower pressure region using an ion detector or particle analyzer.

20. The method for the selective transfer of gas-phase ions, as described of claim 17, further providing controlling and sensing means, whereby the temperature of said interface is controlled, the gas flowing out into said lower pressure region is recorded and metered, the passage of said ions is recorded and metered, and combination thereof.

21. The method for the selective transfer of gas-phase ions, as described of claim 17, further including maintaining said higher pressure region at, near, or above atmospheric pressure.

* * * * *